US009149921B2

(12) United States Patent
Chang

(10) Patent No.: US 9,149,921 B2
(45) Date of Patent: Oct. 6, 2015

(54) FLAT-CLINCH STAPLER HAVING A BUFFERING DEVICE

(71) Applicant: SDI CORPORATION, Chang Hua (TW)

(72) Inventor: Chien-Hsing Chang, Chang Hua (TW)

(73) Assignee: SDI CORPORATION, Chang Hua (TW)

( * ) Notice: Subject to any disclaimer, the term of this patent is extended or adjusted under 35 U.S.C. 154(b) by 512 days.

(21) Appl. No.: 13/743,310

(22) Filed: Jan. 16, 2013

(65) Prior Publication Data

US 2014/0054352 A1 Feb. 27, 2014

(30) Foreign Application Priority Data

Aug. 27, 2012 (TW) ..... 101131039 A

(51) Int. Cl.
*B25C 5/11* (2006.01)
*B25C 5/02* (2006.01)

(52) U.S. Cl.
CPC ..... *B25C 5/0207* (2013.01); *B25C 5/0242* (2013.01); *B25C 5/0271* (2013.01); *B25C 5/11* (2013.01)

(58) Field of Classification Search
CPC ..... B25C 5/02; B25C 5/0207; B25C 5/0242; B25C 5/025; B25C 5/0271; B25C 5/11
USPC ..... 227/134, 140, 152, 154, 155
See application file for complete search history.

(56) References Cited

U.S. PATENT DOCUMENTS

| | | | | |
|---|---|---|---|---|
| 1,962,874 | A * | 6/1934 | Polzer | 227/123 |
| 3,319,863 | A | 5/1967 | Dritz | |
| 5,639,007 | A * | 6/1997 | Nakamura | 227/109 |
| 6,299,047 | B1 * | 10/2001 | Ghibely et al. | 227/134 |
| 6,966,479 | B2 * | 11/2005 | Tanaka et al. | 227/144 |
| 7,140,526 | B2 * | 11/2006 | Matsukawa | 227/132 |
| 7,540,400 | B2 * | 6/2009 | Zins et al. | 227/8 |
| 7,614,537 | B2 * | 11/2009 | Andersson et al. | 227/120 |
| 7,690,545 | B2 * | 4/2010 | Co | 227/125 |

(Continued)

FOREIGN PATENT DOCUMENTS

| | | |
|---|---|---|
| EP | 2 147 752 A1 | 1/2010 |
| WO | 96/09917 A1 | 4/1996 |

OTHER PUBLICATIONS

Extended European Search Report dated Oct. 8, 2013, issued by the European Patent Office concerning EP Application No. EP12199546.8, the counterpart application filed in the European Patent Office.

*Primary Examiner* — Scott A. Smith
(74) *Attorney, Agent, or Firm* — Pai Patent & Trademark Law Firm; Chao-Chang David Pai

(57) ABSTRACT

A flat-clinch stapler has a base, a magazine assembly, a handle device, a flat-clinch device and a buffering device. The magazine assembly and the handle device are pivotally connected with the base. The flat-clinch device has a slider and a moving board. The slider is slidably mounted on the base. The moving board is mounted above the slider and is pivotally connected with the base. The buffering device has a protrusion, a block and an elastic member. The protrusion is securely disposed on the moving board. The block is slidably mounted on the base and abuts the protrusion. The elastic member abuts the block and the base. When the moving board is pivoted, the block is driven by the protrusion to move.

23 Claims, 11 Drawing Sheets

(56) References Cited

U.S. PATENT DOCUMENTS 7,703,652 B2 * 4/2010 Shen ..... 227/134
7,832,609 B2 * 11/2010 Matsukawa ..... 227/120
8,052,022 B2 * 11/2011 Marks ..... 227/129
2006/0138192 A1 6/2006 Matsukawa
2012/0175397 A1 * 7/2012 Co ..... 227/155

* cited by examiner

FLAT-CLINCH STAPLER HAVING A BUFFERING DEVICE

BACKGROUND OF THE INVENTION

1. Field of the Invention

The present invention relates to a flat-clinch stapler, and more particularly to a flat-clinch stapler having a buffering device.

2. Description of Related Art

With reference to FIG. 11, a flat-clinching procedure of a conventional flat-clinch stapler mainly has two steps. The first step is that a handle device 70 drives a slider 81 to slide, and a moving board 82 is free to pivot. The second step is that the moving board 82 is driven by the handle device 70 to overwhelm an elastic force of a moving board spring 83 and then is pivoted downwards. Accordingly, a staple is flat-clinched by a clinch unit of the flat-clinch stapler.

The conventional flat-clinch stapler is designed to staple up to 40 sheets of paper, and the moving board spring 83 must have high coefficient of elasticity such that the flat-clinch stapler has a good flat-clinching effect when stapling 40 sheets of paper. However, the moving board spring 83 having high coefficient of elasticity weakens the flat-clinch effect when the flat-clinch stapler staples few sheets of paper.

The user will not apply a strong force to the conventional flat-clinch stapler when the flat-clinch stapler is used to staple only few sheets of paper, for example, two sheets of paper. When the moving board 82 is pivoted downwards, the user often misjudges, assuming that the moving board 82 is pivoted to a specific position and the flat-clinching procedure is accomplished. In fact, the moving board 82 has not yet been pivoted to the specific position and has not overwhelmed the strong elastic force of the moving board spring 83. Consequently, leg portions of the staple are not actually flat-clinched, and an opening is formed between the leg portions.

In sum, when stapling few sheets of paper, the conventional flat-clinch stapler easily causes the user to misjudge, assuming that the staple is flat-clinched, and not to press the moving board 82 to the farthest down. The conventional flat-clinch stapler cannot provide a good flat-clinching effect and needs to be improved.

To overcome the shortcomings, the present invention tends to provide a flat-clinch stapler having a buffering device to mitigate the aforementioned problems.

SUMMARY OF THE INVENTION

The main objective of the invention is to provide a flat-clinch stapler having a buffering device. With the buffering device being mounted between a moving board and a base, a user mainly overwhelms an elastic force of an elastic member of the buffering device, instead of an elastic force of a conventional moving board spring. When a block is pushed by a protrusion of the buffering device to a specific position, a flat-clinching procedure is accomplished, and the user will not misjudge.

The flat-clinch stapler has a base, a magazine assembly, a handle device, a flat-clinch device and a buffering device. The magazine assembly and the handle device are pivotally connected with the base. The flat-clinch device has a slider and a moving board. The slider is slidably mounted on the base. The moving board is mounted above the slider and is pivotally connected with the base. The buffering device has a protrusion, a block and an elastic member. The protrusion is securely disposed on the moving board. The block is slidably mounted on the base and abuts the protrusion. The elastic member abuts the block and the base. When the moving board is pivoted, the block is driven by the protrusion to move.

Other objects, advantages and novel features of the invention will become more apparent from the following detailed description when taken in conjunction with the accompanying drawings.

DETAILED DESCRIPTION OF PREFERRED EMBODIMENT

Figure 1:
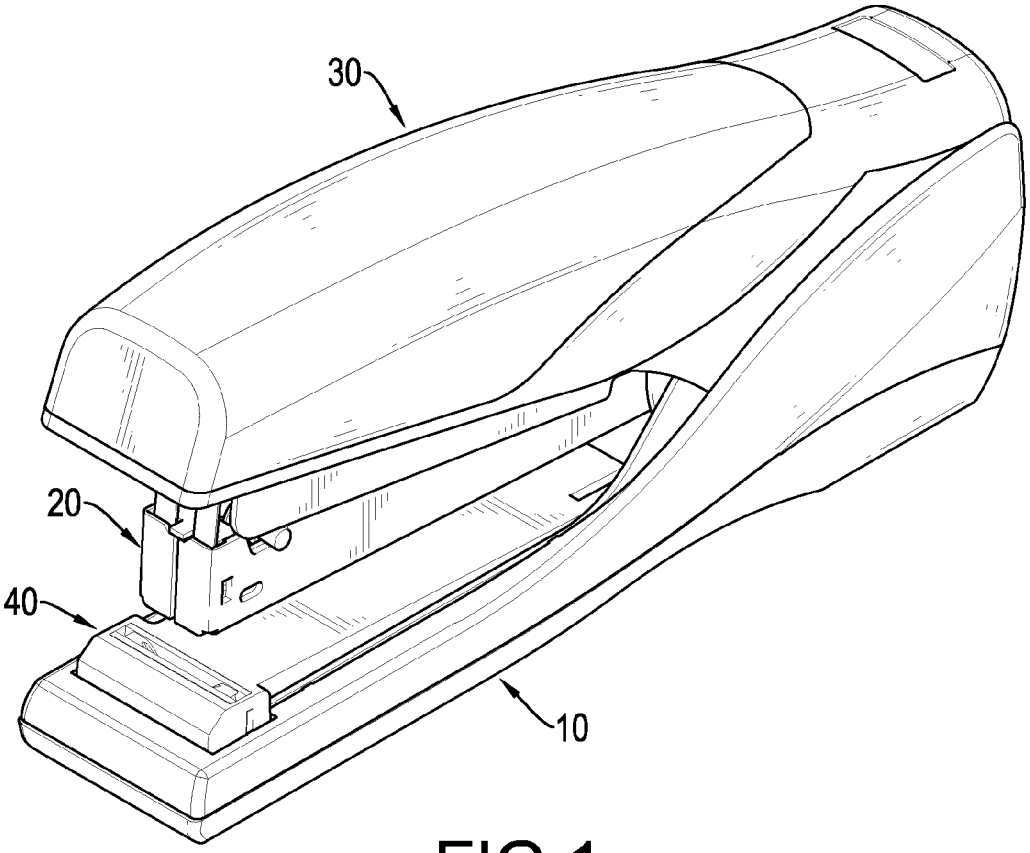
FIG. 1 is a perspective view of a first embodiment of a flat-clinch stapler in accordance with the present invention.
Figure 2:
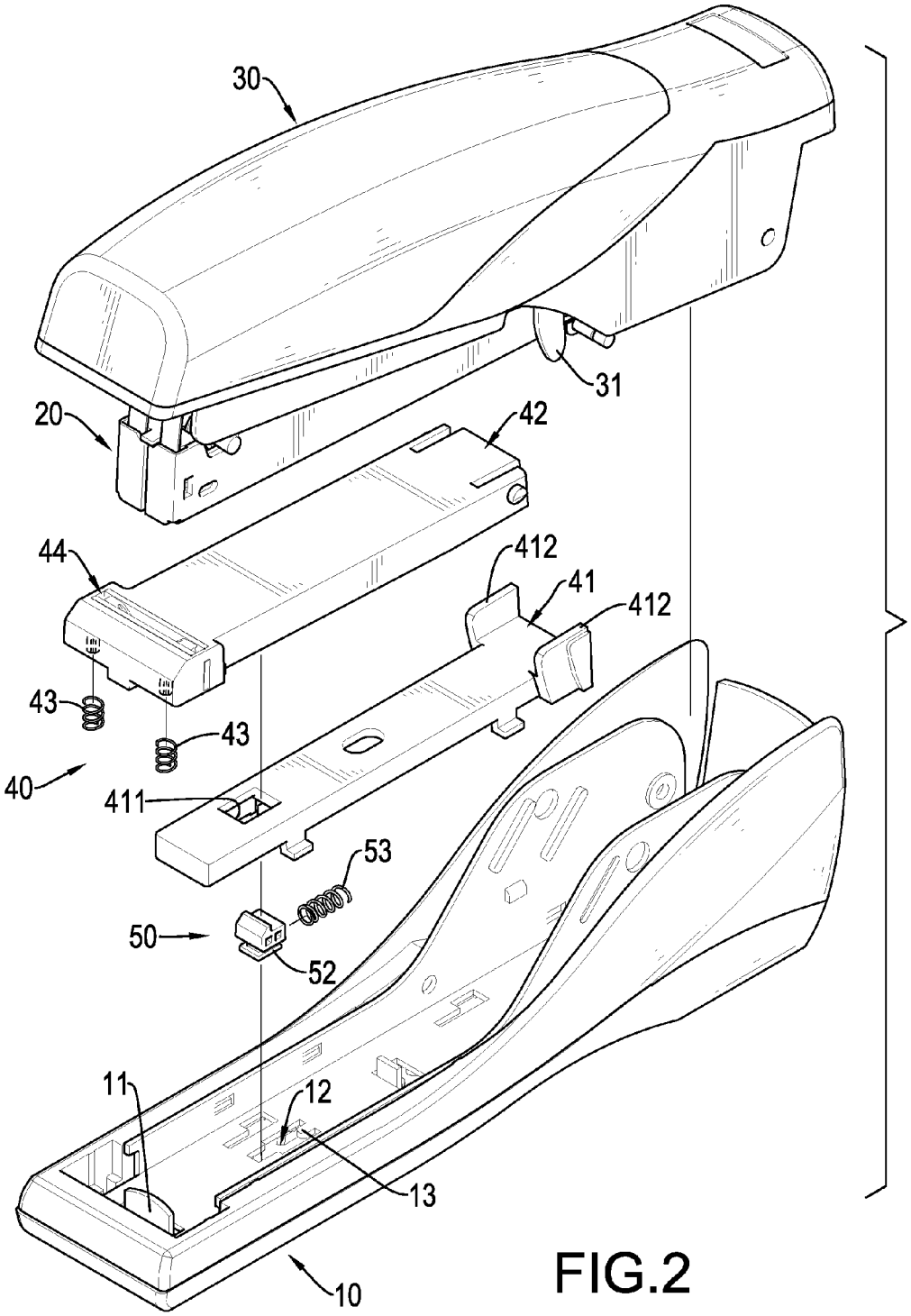
FIG. 2 is a partially exploded perspective view of the flat-clinch stapler in FIG. 1.

With reference to FIGS. 1 to 2, a first embodiment of a flat-clinch stapler in accordance with the present invention comprises a base 10, a magazine assembly 20, a handle device 30, a flat-clinch device 40 and a buffering device 50.

Figure 5:
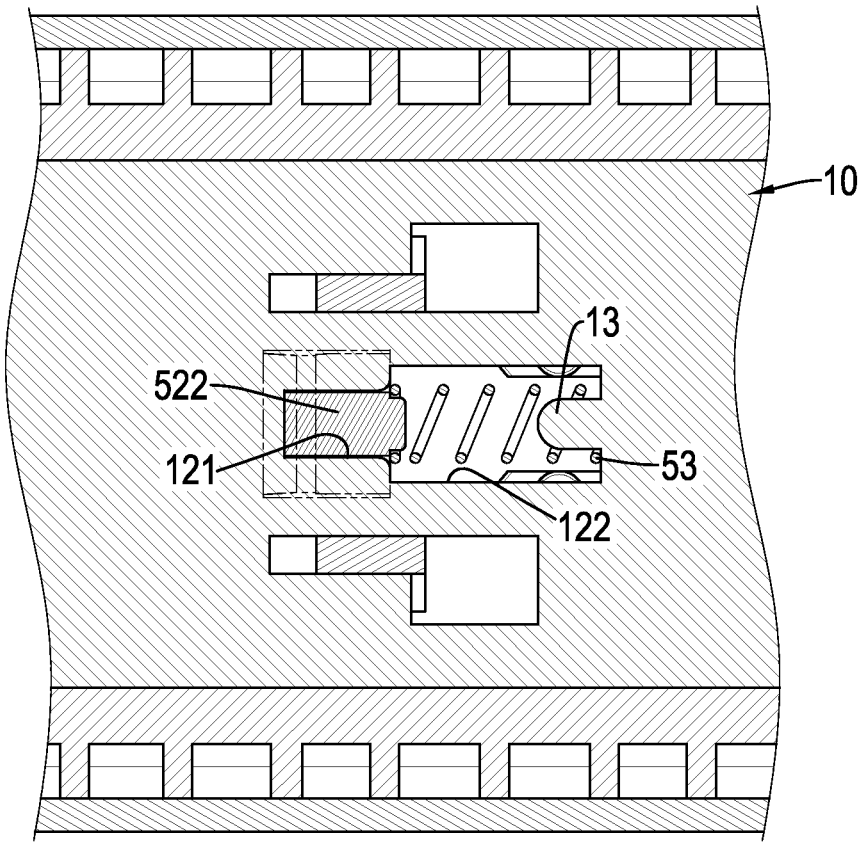
FIG. 5 is an enlarged cross sectional top view of the flat-clinch stapler in FIG. 1.

With reference to FIGS. 1, 2 and 5, the base 10 has a front end, a middle segment and a rear end. The rear end of the base 10 is opposite to the front end of the base 10. The middle segment of the base 10 is located between the front end and the rear end of the base 10.

Preferably, the base 10 has a prop 11, a guiding groove 12 and a protuberance 13. The prop 11 protrudes from the front end of the base 10 and extends laterally. The guiding groove 12 is formed in the middle segment of the base 10 and extends toward the front end and the rear end of the base 10. The guiding groove 12 has a rectangular front area 121 and a rectangular rear area 122. The front area 121 of the guiding groove 12 has a width. The rear area 122 communicates with the front area 121 and has a width larger than that of the front area 121. The protuberance 13 protrudes from an inner surface of the rear area 122 of the guiding groove 12.

The magazine assembly 20 has a rear end and a bottom side. The rear end of the magazine assembly 20 is pivotally connected with the rear end of the base 10.

The handle device 30 is mounted above the magazine assembly 20 and has a rear end and two arms 31. The rear end of the handle device 30 is pivotally connected with the rear end of the base 10. The arms 31 protrude downwards from the handle device 30 and respectively have a bottom end. The two bottom ends of the arms 31 are located below the bottom side of the magazine assembly 20. The magazine assembly 20 and the handle device 30 may be conventional and detailed description is omitted.

Figure 3:
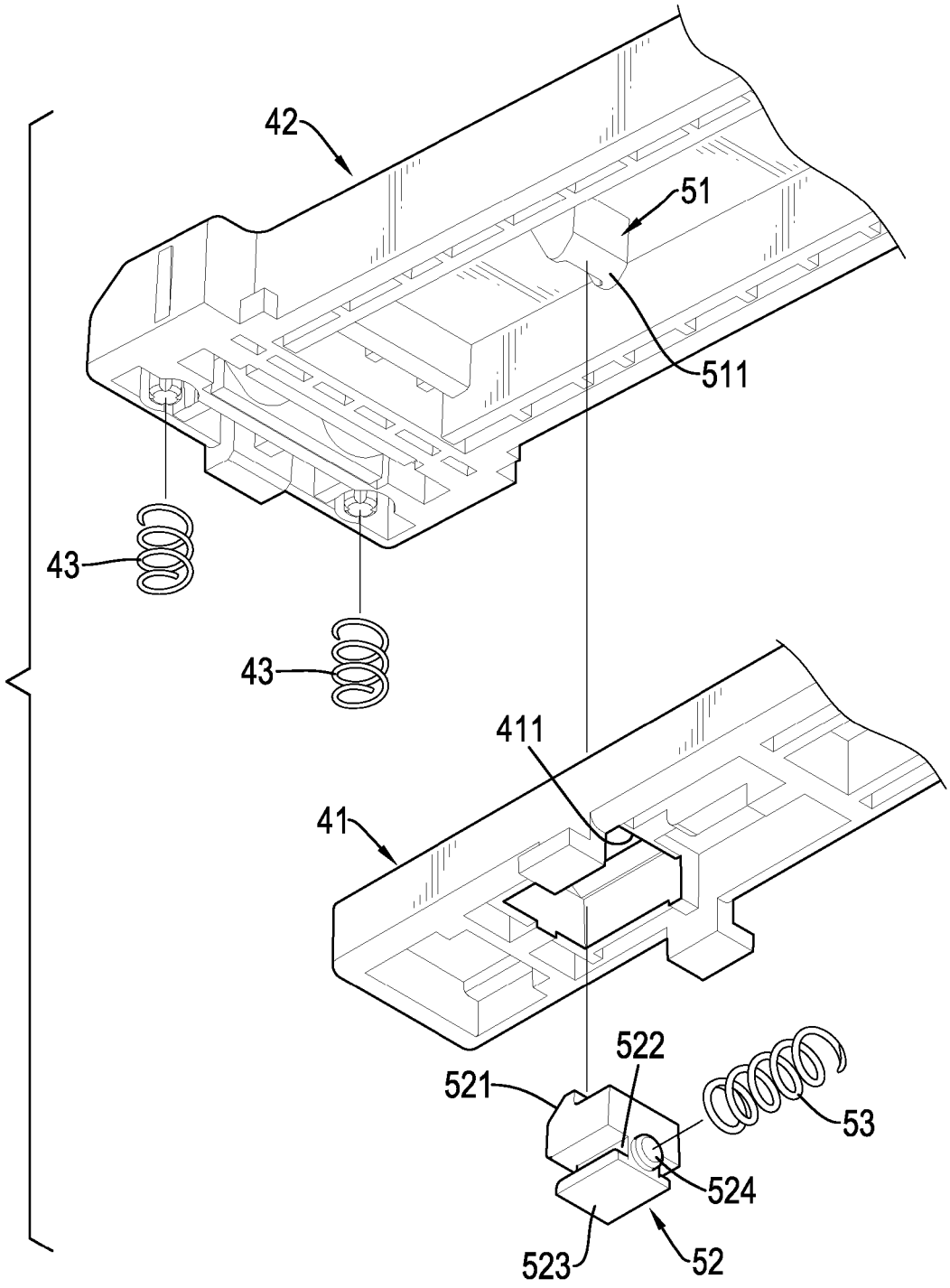
FIG. 3 is an enlarged partially exploded perspective view of the flat-clinch stapler in FIG. 2.
Figure 4:
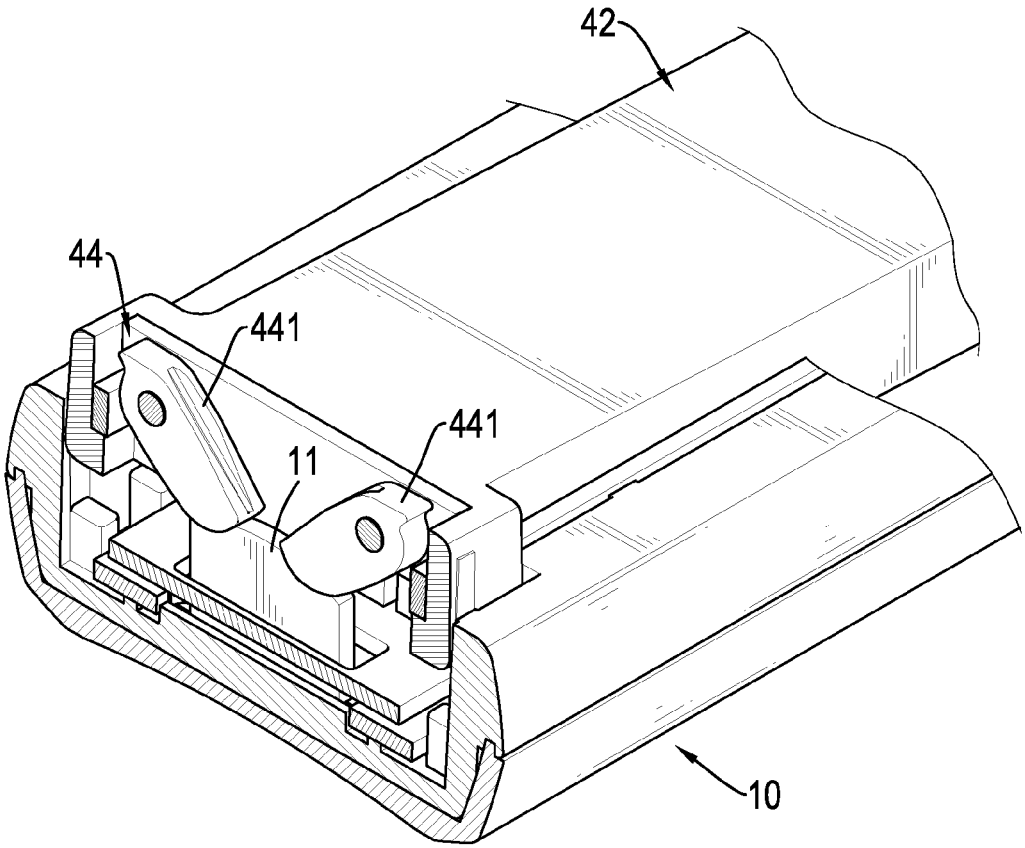
FIG. 4 is an enlarged perspective view in partial section of the flat-clinch stapler in FIG. 1.

With reference to FIGS. 2 to 4, the flat-clinch device 40 has a slider 41, a moving board 42, two moving board springs 43 and a clinch unit 44.

The slider 41 is slidably mounted on the middle segment of the base 10, and has a front end, a rear end, a through hole 411 and two pushed sections 412. The front end of the slider 41 is adjacent to the front end of the base 10. The rear end of the slider 41 is opposite to the front end of the slider 41. The through hole 411 of the slider 41 is rectangular and is formed through the slider 41. The pushed sections 412 protrude from and are respectively located at two opposite sides of the rear end of the slider 41.

The two arms 31 descend and respectively abut the pushed sections 412 when the handle device 30 is pivoted. Then the two arms 31 are gradually pivoted and respectively push the pushed sections 412. Accordingly, the handle device 30 can drive the slider 41 to slide backwardly.

The moving board 42 is mounted above the slider 41 and has a bottom surface, a front end and a rear end. The rear end of the moving board 42 is opposite to the front end of the moving board 42 and is pivotally connected with the base 10. The moving board 42 is restricted by the slider 41 and prevented from descending when the slider 41 does not move backwardly toward the rear end of the base 10.

The two moving board springs 43 are mounted below the front end of the moving board 42. Each moving board spring 43 has two ends respectively abutting the front end of the moving board 42 and the front end of the base 10. The moving board springs 43 enable the pivoted moving board 42 to return to an original position of the moving board 42.

The clinch unit 44 is mounted in the front end of the moving board 42. Preferably, the clinch unit 44 has two pivoting chunks 441. The pivoting chunks 441 are respectively and pivotally mounted in two opposite sides of the front end of the moving board 42 and respectively have a bottom. Two pivoting points of the two pivoting chunks 441 are located at a horizontal plane. When the moving board 42 is pivoted downwards, the pivoting chunks 441 are pushed by the prop 11 to respectively pivot upwards. Accordingly, a staple is flat-clinched.

Figure 6:
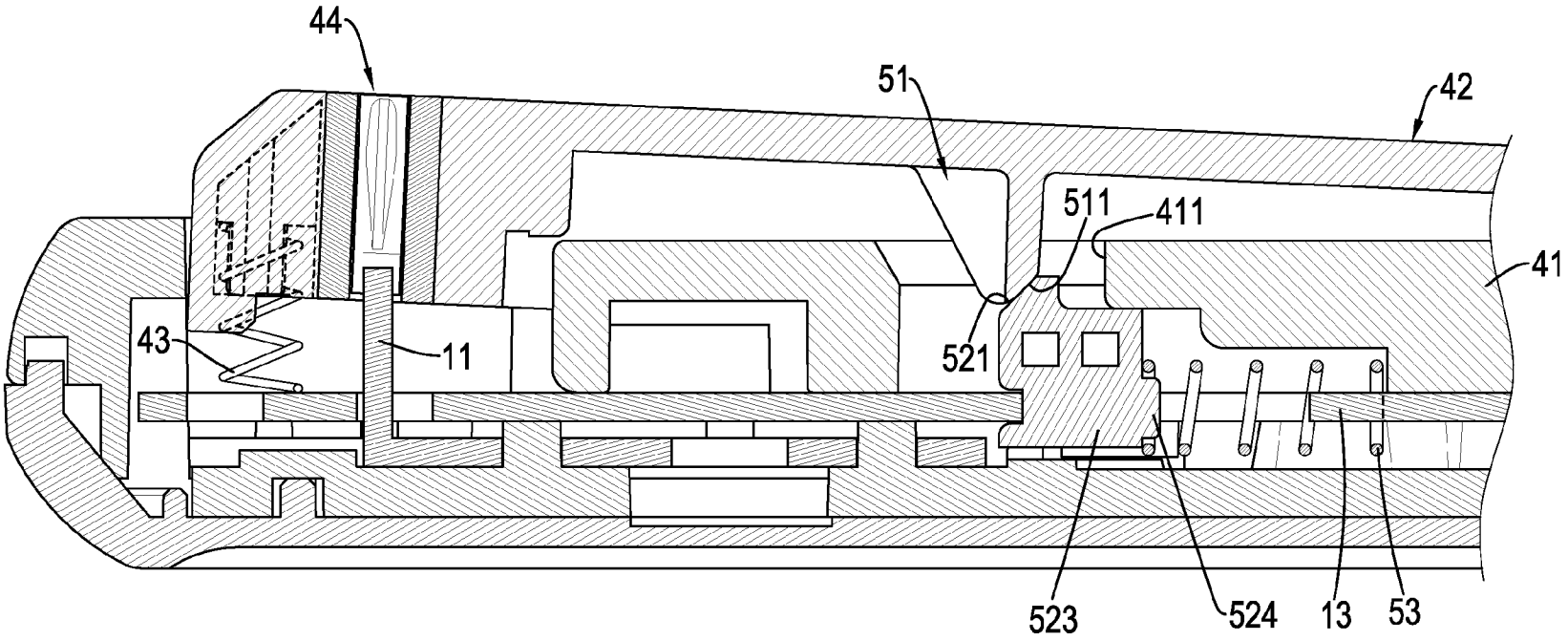
FIG. 6 is an enlarged side view in partial section of the flat-clinch stapler in FIG. 1 showing that the moving board is not pivoted.

With reference to FIGS. 2, 3, and 6, the buffering device 50 has a protrusion 51, a block 52 and an elastic member 53.

The protrusion 51 is formed on the bottom surface of the moving board 42, is mounted through the through hole 411 of the slider 41, and has a protrusion abutting section 511 and a rear end having a bottom side. The protrusion abutting section 511 is formed at the bottom side of the rear end of the protrusion 51.

The block 52 is mounted on the middle segment of the base 10, is slidable between the front end and the rear end of the base 10 and has a front end, a rear side, a block abutting section 521, a guiding section 522, a restricting section 523 and a lump section 524. The front end of the block 52 has a top side.

The block abutting section 521 is formed at the top side of the front end of the block 52 and is abutted by the protrusion abutting section 511.

Figure 9:
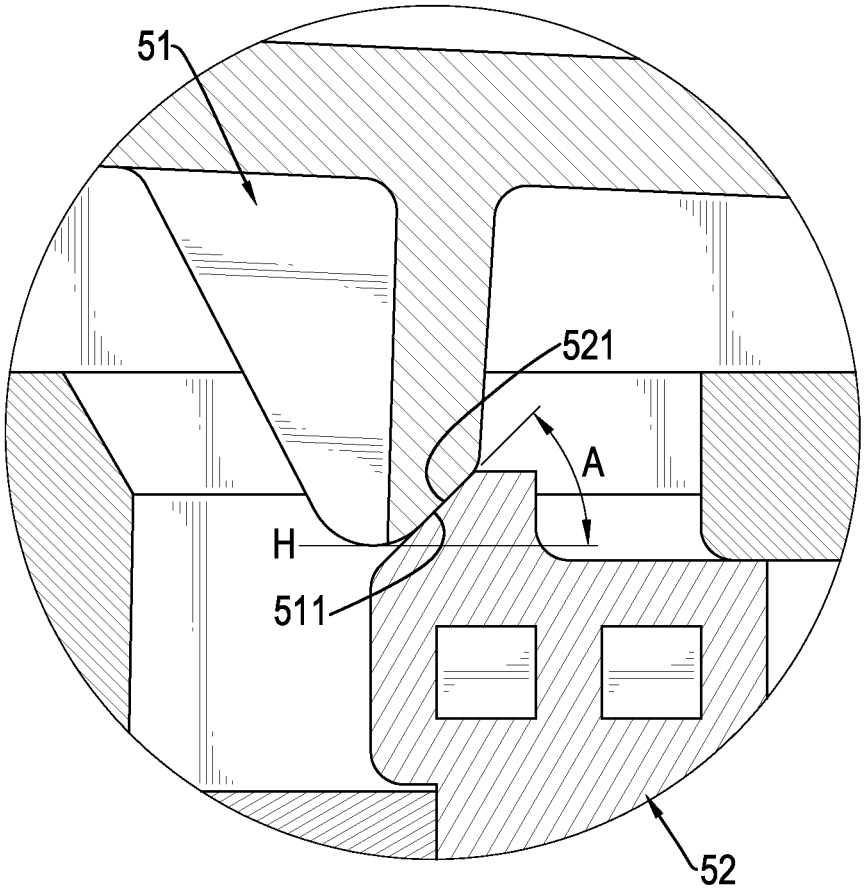
FIG. 9 is an enlarged cross sectional side view of the flat-clinch stapler in FIG. 1 showing that the protrusion abuts the block.

With reference to FIG. 9, preferably, the protrusion abutting section 511 and the block abutting section 521 are inclined planes. An angle between the block abutting section 521 and a horizontal plane H ranges from 30° (degrees) to 60° (degrees).

With further reference to FIG. 5, the guiding section 522 is mounted in the front area 121 of the guiding groove 12 such that the block 52 is capable of sliding along the guiding groove 12 forwardly or backwardly.

The restricting section 523 is a rectangular plate, is located below and is formed on the guiding section 522, and has a width larger than that of the front area 121 of the guiding groove 12. The restricting section 523 prevents the block 52 from escaping from the base 10. The lump section 524 is located at the rear side of the block 52.

The elastic member 53 extends toward the front end and the rear end of the base 10 and abuts the block 52 and the base 10. The protrusion 51 can drive the block 52 to move. Preferably, the elastic member 53 is a compression spring. Two opposite ends of the elastic member 53 are respectively mounted around the protuberance 13 and the lump section 524 of the block 52.

Figure 7:
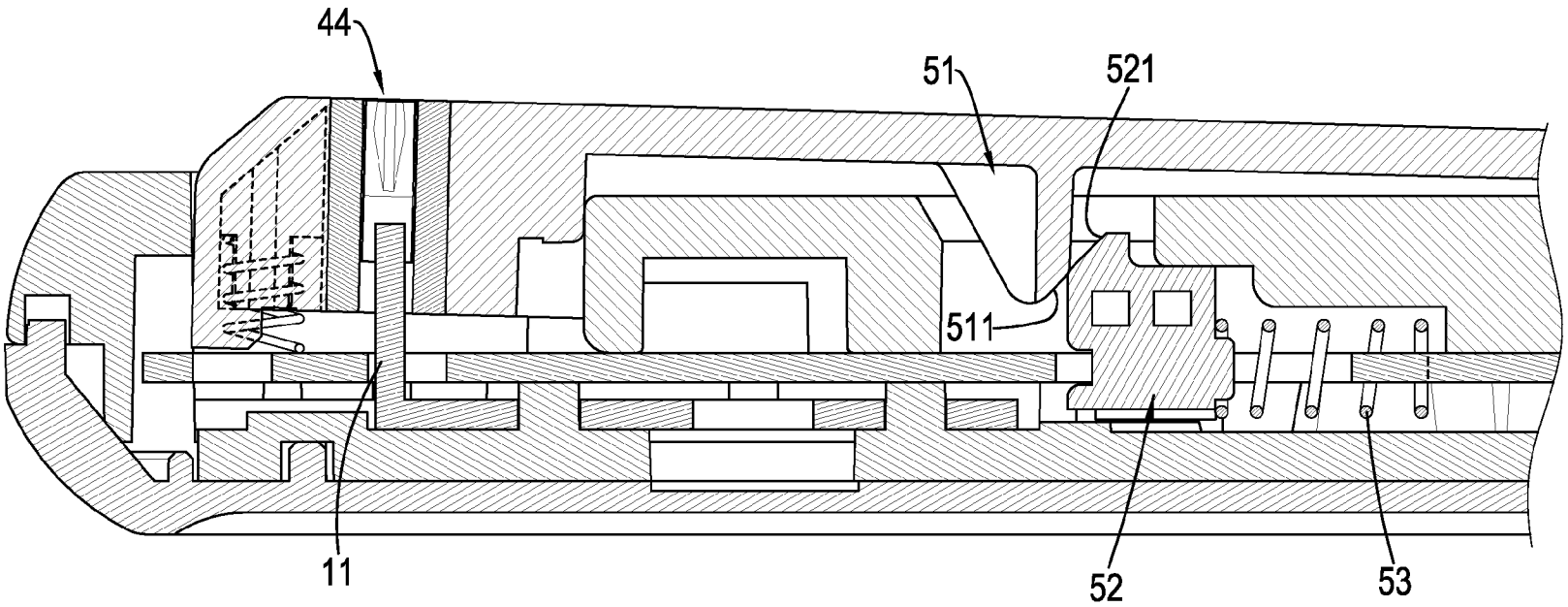
FIG. 7 is an enlarged side view in partial section of the flat-clinch stapler in FIG. 1 showing that the moving board is being pivoted.
Figure 8:
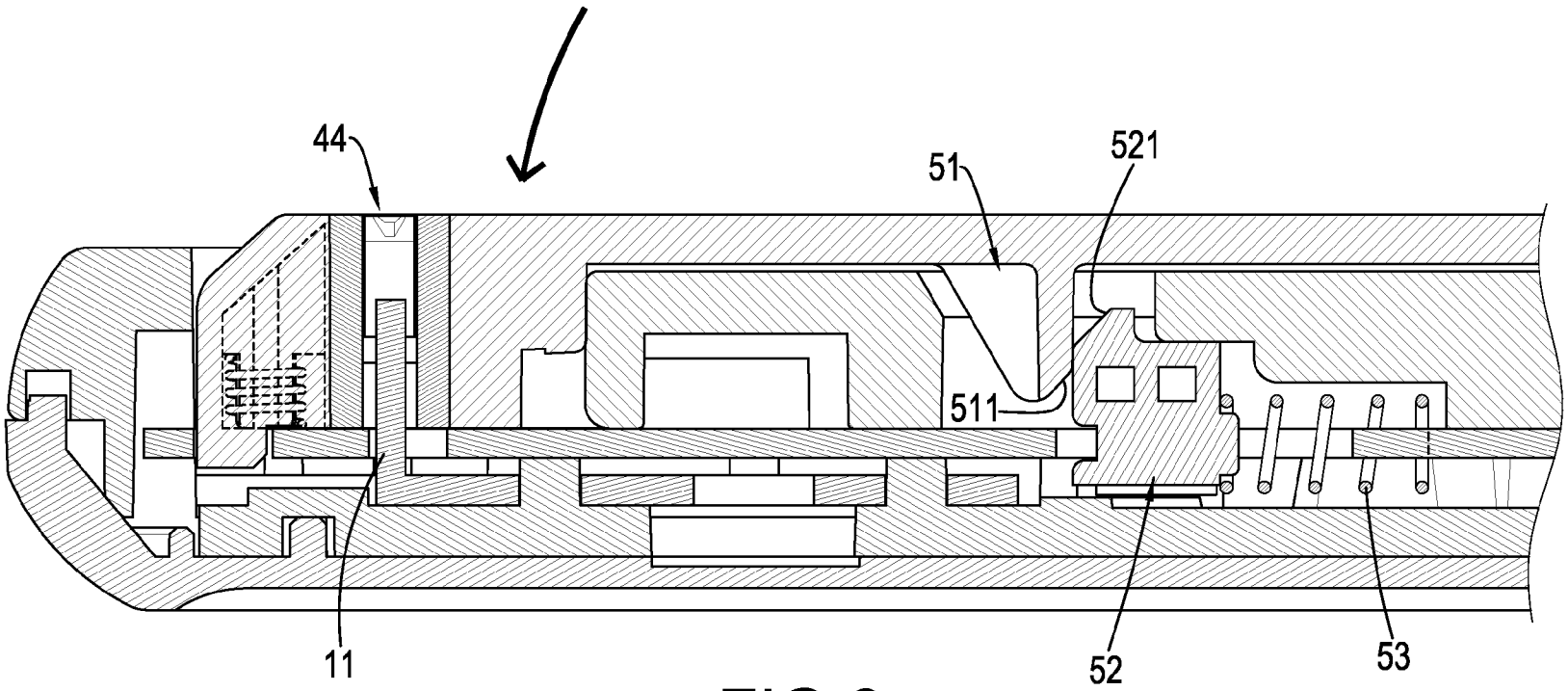
FIG. 8 is an enlarged side view in partial section of the flat-clinch stapler in FIG. 1 showing that the moving board is pivoted to the farthest down.

With reference to FIGS. 6 to 8, the flat-clinch stapler in accordance with the present invention is being used.

First, the handle device 30 is pivoted and the magazine assembly 20 is also pivoted. The slider 41 is pushed to slide backwardly relative to the base 10. After the slider 41 slides, the moving board 42 can be pivoted downwards without being restricted by the slider 41.

The protrusion 51 descends as the moving board 42 is pivoted. With the protrusion abutting section 511 abutting the block abutting section 521, the protrusion 51 pushes the block 52 to make the block 52 slide backwardly along the guiding groove 12. Accordingly, the elastic member 53 is gradually compressed.

Meanwhile, the prop 11 enters the front end of the moving board 42 and upwards pushes the two pivoting chunks 441 when the moving board 42 is gradually pivoted downwards. Consequently, the two pivoting chunks 441 are pivoted and flat-clinches a staple.

Finally, when the block 52 is pushed by the protrusion 51 to a specific position, the pivoting chunks 441 are also pivoted by the prop 11 to the specific position to accomplish the flat-clinching procedure. At the moment that the moving board 42 is free from being restricted by the slider 41 and begins to descend, the moving board 42 does not abruptly pivot and descend. This is because the protrusion 51 formed on the moving board 42 remains to abut the block 52. The moving board 42 can descend and pivot after a pressing force of a user increases to overwhelm an elastic force of the elastic member 53. Accordingly, the user mainly overwhelms the elastic force of the elastic member 53 of the buffering device 50, instead of an elastic force of a conventional moving board spring. When the block 52 is pushed by the protrusion 51 to the specific position, the flat-clinching procedure is accomplished, and the user will not misjudge. Accordingly, the present invention enables the user to smoothly use the stapler, free from an awkward and abrupt feel when pressing the moving board 42.

In the present invention, at least one of the protrusion abutting section 511 and the block abutting section 521 is an inclined surface such that the block 52 can be pushed by the protrusion 51 to slide.

Furthermore, the protrusion abutting section 511 and the block abutting section 521 are not restricted to be inclined planes, and may be inclined convex surfaces. The protrusion abutting section 511 or the block abutting section 521 is inclined such that the block 52 can be pushed by the protrusion 51 to slide. The present invention does not limit the formats of the protrusion abutting section 511 and the block abutting section 521. Preferably, the angle between the block abutting section 521 and a horizontal plane ranges from 30° (degrees) to 60° (degrees) to achieve an optimal result.

Figure 10:
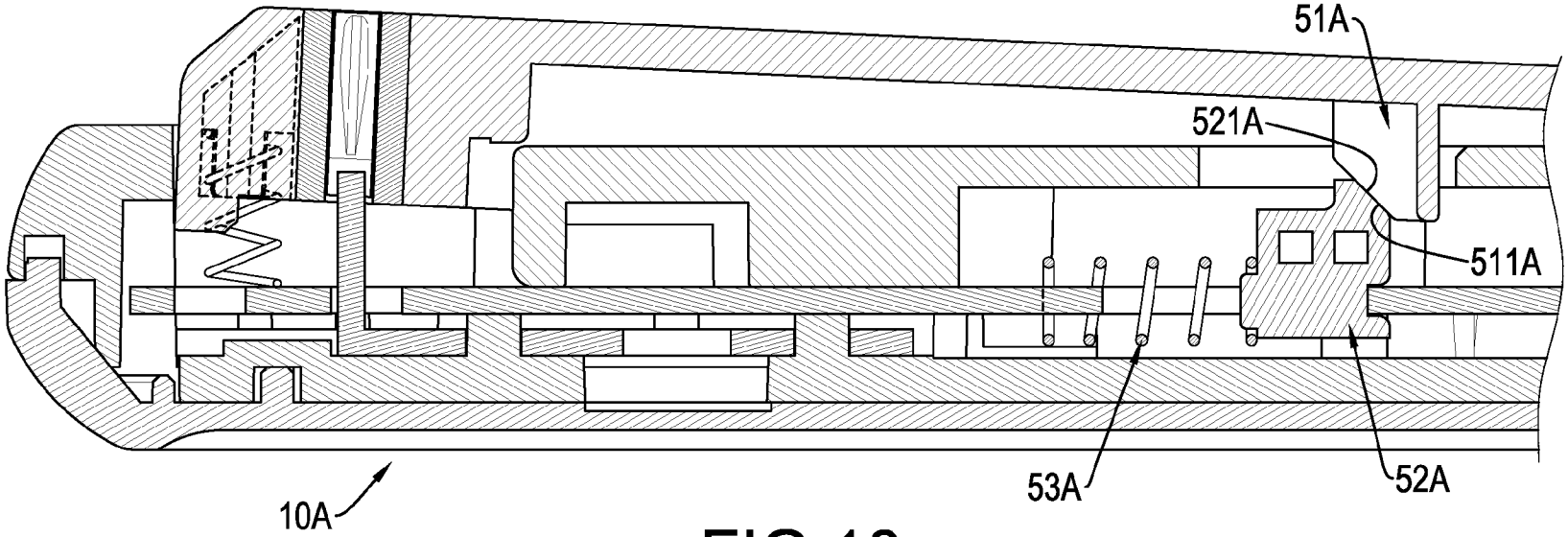
FIG. 10 is an enlarged side view in partial section of a second embodiment of the flat-clinch stapler in accordance with the present invention showing that the protrusion abuts the block.
Figure 11:
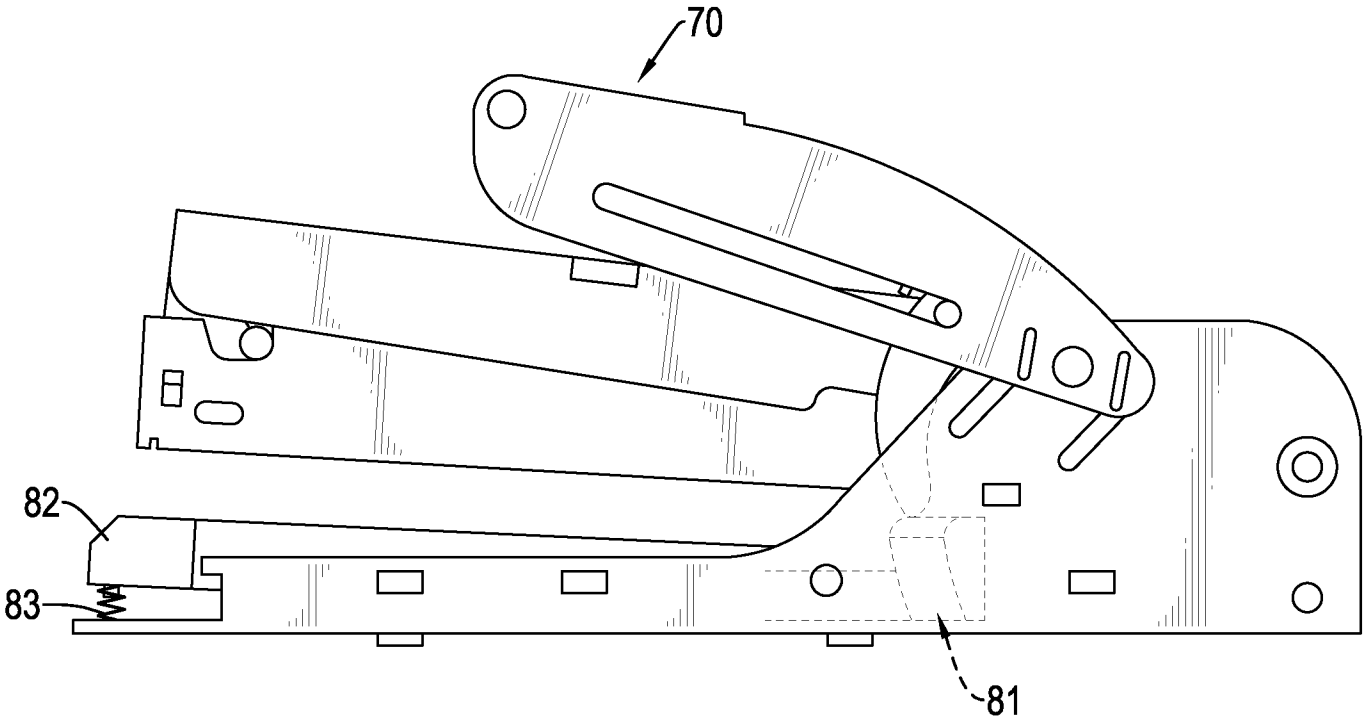
FIG.11 PRIOR ART
FIG. 11 is a side view of a conventional flat-clinch stapler in accordance with the prior art.

With reference to FIG. 10, a second embodiment of the flat-clinch stapler in accordance with the present invention is substantially the same as the first embodiment. The protrusion 51A has a front end having a bottom side. The protrusion abutting section 511A is formed at the bottom side of the front end of the protrusion 51A. The block 52A has a rear end having a top side. The block abutting section 521A is formed at the top side of the rear end of the block 52A. The elastic member 53A is a compression spring located in front of the block 52A, and two opposite ends of the elastic member 53A are respectively and securely mounted on the block 52A and the base 10A. Accordingly, the elastic member 53A is compressed when the block 52A is pushed by the protrusion 51A, and a buffering effect is also achieved. The present invention does not limit locations and formats of the protrusion 51,51A, the block 52,52A and the elastic member 53,53A.

The present invention may not have the guiding groove 12 and may have a track instead. The track is mounted on the middle segment of the base 10 and is connected with the block 52. Accordingly, the track can guide the block 52 and enables the block 52 to be slid forwardly or backwardly.

From the above description, it is noted that the present invention has the following advantages:

At the moment that the moving board 42 is not restricted by the slider 41 and begins to descend, the moving board 42 does not abruptly pivot and descend. This is because the protrusion 51,51A formed on the moving board 42 remains to abut the block 52,52A. The moving board 42 can gradually pivot for flat-clinching after the pressing force of the user increases to overwhelm the elastic force of the elastic member 53,53A.

Accordingly, the user mainly overwhelms the elastic force of the elastic member 53,53A of the buffering device 50, instead of an elastic force of a conventional moving board spring. When the block 52,52A is pushed by the protrusion 51,51A to a specific position, the flat-clinching procedure is accomplished, and the user will not misjudge. Furthermore, the present invention enables the user to smoothly use the stapler, and does not cause an awkward and abrupt feel of the user when pressing the moving board.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flat-clinch stapler comprising:
- a base having
  - a front end;
  - a rear end opposite to the front end; and
  - a middle segment located between the front end and the rear end;
- a magazine assembly having a rear end pivotally connected with the rear end of the base;
- a handle device mounted above the magazine assembly and having a rear end pivotally connected with the rear end of the base;
- a flat-clinch device having
  - a slider capable of being driven by the handle device, slidably mounted on the middle segment of the base, and having
    - a through hole formed through the slider; and
    - a front end adjacent to the front end of the base;
  - a moving board mounted above the slider and having
    - a bottom surface; and
    - a rear end pivotally connected with the base, wherein the moving board is restricted by the slider and prevented from descending before the slider is moved backwardly toward the rear end of the base; and
  - a clinch unit mounted in the front end of the moving board; and
- a buffering device having
  - a protrusion securely disposed on the bottom surface of the moving board, mounted through the through hole of the slider, and having a protrusion abutting section;
  - a block mounted on the middle segment of the base, being slidable between the front end and the rear end of the base, capable of being driven by the protrusion when the moving board is pivoted, and having
    - a block abutting section abutted by the protrusion abutting section, wherein at least one of the protrusion abutting section and the block abutting section is an inclined surface; and
  - an elastic member extending toward the front end and the rear end of the base and abutting the block and the base.

2. The flat-clinch stapler as claimed in claim 1, wherein the protrusion abutting section and the block abutting section are inclined planes.

3. The flat-clinch stapler as claimed in claim 2, wherein an angle between the block abutting section and a horizontal plane ranges from 30° (degrees) to 60° (degrees).

4. The flat-clinch stapler as claimed in claim 3, wherein the protrusion has a rear end having a bottom side;
- the protrusion abutting section is formed at the bottom side of the rear end of the protrusion;
- the block has a front end having a top side; and
- the block abutting section is formed at the top side of the front end of the block.

5. The flat-clinch stapler as claimed in claim 4, wherein the elastic member is a spring.

6. The flat-clinch stapler as claimed in claim 5, wherein the elastic member is a compression spring.

7. The flat-clinch stapler as claimed in claim 6, wherein the base has
- a guiding groove formed in the middle segment of the base and extending toward the front end and the rear end of the base; and
- the block is mounted on the guiding groove and capable of sliding along the guiding groove.

8. The flat-clinch stapler as claimed in claim 7, wherein the block further has
- a rear side;
- a guiding section mounted in the guiding groove;
- a restricting section being a plate, located below and securely disposed on the guiding section, and having a width larger than that of the guiding groove; and
- a lump section located at the rear side of the block.

9. The flat-clinch stapler as claimed in claim 8, wherein the clinch unit has
- two pivoting chunks respectively and pivotally mounted in two opposite sides of the front end of the moving board and respectively having a bottom, wherein two pivoting points of the two pivoting chunks are located at a horizontal plane;

the base has a prop disposed at the front end of the base and abutting the bottoms of the two pivoting chunks, wherein the two pivoting chunks are pushed by the prop to respectively pivot upwards when the moving board is pivoted downwards.

10. The flat-clinch stapler as claimed in claim 9, wherein the guiding groove has a rectangular front area having a width; and a rectangular rear area communicating with the front area and having a width larger than that of the front area.

11. The flat-clinch stapler as claimed in claim 3, wherein the protrusion has a front end having a bottom side;

the protrusion abutting section is formed at the bottom side of the front end of the protrusion;

the block has a rear end having a top side; and the block abutting section is formed at the top side of the rear end of the block.

12. The flat-clinch stapler as claimed in claim 9, wherein the elastic member is a spring.

13. The flat-clinch stapler as claimed in claim 12, wherein the elastic member is a compression spring.

14. The flat-clinch stapler as claimed in claim 2, wherein the protrusion has a rear end having a bottom side;

the protrusion abutting section is formed at the bottom side of the rear end of the protrusion;

the block has a front end having a top side; and the block abutting section is formed at the top side of the front end of the block.

15. The flat-clinch stapler as claimed in claim 2, wherein the protrusion has a front end having a bottom side;

the protrusion abutting section is formed at the bottom side of the front end of the protrusion;

the block has a rear end having a top side; and the block abutting section is formed at the top side of the rear end of the block.

16. The flat-clinch stapler as claimed in claim 1, wherein the protrusion has a rear end having a bottom side;

the protrusion abutting section is formed at the bottom side of the rear end of the protrusion;

the block has a front end having a top side; and the block abutting section is formed at the top side of the front end of the block.

17. The flat-clinch stapler as claimed in claim 1, wherein the protrusion has a front end having a bottom side;

the protrusion abutting section is formed at the bottom side of the front end of the protrusion;

the block has a rear end having a top side; and the block abutting section is formed at the top side of the rear end of the block.

18. The flat-clinch stapler as claimed in claim 1, wherein the elastic member is a spring.

19. The flat-clinch stapler as claimed in claim 18, wherein the elastic member is a compression spring.

20. The flat-clinch stapler as claimed in claim 1, wherein the base has a guiding groove formed in the middle segment of the base and extending toward the front end and the rear end of the base; and the block is mounted on the guiding groove and capable of sliding along the guiding groove.

21. The flat-clinch stapler as claimed in claim 20, wherein the block further has a rear side;

a guiding section mounted in the guiding groove;

a restricting section being a plate, located below and securely disposed on the guiding section, and having a width larger than that of the guiding groove; and a lump section located at the rear side of the block.

22. The flat-clinch stapler as claimed in claim 20, wherein the guiding groove has a rectangular front area having a width; and a rectangular rear area communicating with the front area and having a width larger than that of the front area.

23. The flat-clinch stapler as claimed in claim 1, wherein the clinch unit has two pivoting chunks respectively and pivotally mounted in two opposite sides of the front end of the moving board and respectively having a bottom, wherein two pivoting points of the two pivoting chunks are located at a horizontal plane;

the base has a prop disposed at the front end of the base and abutting the bottoms of the two pivoting chunks, wherein the two pivoting chunks are pushed by the prop to respectively pivot upwards when the moving board is pivoted downwards.

* * * * *